United States Patent [19]

Masaki et al.

[11] 4,123,901

[45] Nov. 7, 1978

[54] AIR-FUEL RATIO CONTROL SYSTEM FOR AN INTERNAL COMBUSTION ENGINE WITH A THERMAL REACTOR

[75] Inventors: Kenji Masaki, Yokohama; Suzuo Suzuki, Yokosuka, both of Japan

[73] Assignee: Nissan Motor Company, Limited, Japan

[21] Appl. No.: 719,699

[22] Filed: Sep. 2, 1976

[30] Foreign Application Priority Data

Sep. 11, 1975 [JP] Japan ..... 50/110164

[51] Int. Cl.[2] ..... F02B 75/10

[52] U.S. Cl. ..... 60/277; 60/285; 123/119 EC; 123/119 LR

[58] Field of Search ..... 60/276, 285, 284, 277; 123/119 EC, 119 LR

[56] References Cited

U.S. PATENT DOCUMENTS

| | | | |
|---|---|---|---|
| 3,732,696 | 5/1973 | Masaki | 60/284 |
| 3,827,237 | 8/1974 | Linder | 60/301 |
| 3,921,612 | 11/1975 | Aono | 123/119 EC |
| 3,982,393 | 9/1976 | Masaki | 60/285 |
| 3,986,352 | 10/1976 | Casey | 60/276 |

*Primary Examiner*—Douglas Hart

*Attorney, Agent, or Firm*—Robert E. Burns; Emmanuel J. Lobato; Bruce L. Adams

[57] ABSTRACT

Under normal running condition of an internal combustion engine with a thermal reactor, the engine is fed with a relatively rich air-fuel mixture for regulating the concentration of unburned combustible compounds, such as hydrocarbons (HC) and carbon monoxide (CO) in the exhaust gases emitted therefrom, in a manner that the thermal reactor effectively functions, and under high speed heavy load condition of the engine wherein the exhaust gas temperature becomes remarkably high, the engine is alternately fed with a relatively rich mixture and a relatively lean mixture in accordance with the operating cycles of the engine for not only achieving the improved fuel economy but also protecting the thermal reactor from heat damage.

12 Claims, 7 Drawing Figures

AIR-FUEL RATIO CONTROL SYSTEM FOR AN INTERNAL COMBUSTION ENGINE WITH A THERMAL REACTOR

BACKGROUND OF THE INVENTION

The present invention relates in general to a control system for an internal combustion engine equipped at its exhaust section with a thermal reactor, and more particularly to a control system for regulating the engine exhaust gases fed into the thermal reactor in such a way that the reactor functions effectively.

Some modernized motor vehicles are equipped with thermal reactors in the exhaust sections of the internal combustion engines in order to completely burn out the remaining unburned combustible compounds such as hydrocarbons (HC) and carbon monoxide (CO) in exhaust gases emitted from the engines before the exhaust gases are discharged to the atmosphere.

In these thermal reactors, it has been recognized that, for achieving the effective combustion of the harmful combustible compounds mentioned above, it is necessary not only to maintain the exhaust gases fed into the reactor at highest possible temperature but also control the amounts of combustible compounds in the exhaust gases so that these combustible compounds can be effectively oxidized in the reactors.

As is well known, the temperature of the exhaust gases from the engine is severely and frequently changed in response to the various operating conditions of the engine thereby causing a difficulty in maintenance of the exhaust gases at the highest possible temperature. Thus, hitherto, the effective combustion of the combustible compounds in the thermal reactor has been achieved mainly by controlling the engine so as to produce exhaust gases containing considerably large amounts of hydrocarbons (HC) and carbon monoxide (CO). In reality, this exhaust contents control is made by feeding the engine with a relatively rich air-fuel mixture, for example, with the air-fuel ratio ranging from 11/1 to 14/1. (The stoichiometric air-fuel ratio of the mixture is about 14.8/1.)

With this procedure, it inevitably occures that the fuel economy of the subject system becomes worse due to the rich mixture combustion in a wasteful manner.

Furthermore, in this procedure, when the engine is subjected to a heavy load high speed operation during its working, there will arise a fear that the thermal reactor will be damaged or otherwise broken by the remarkably high heat generated in the thermal reactor. This is because the exhaust gases emitted from the heavily operating engine have in themselves considerably high temperature which promotes violent oxidation of the relatively large amounts of the remaining combustible compounds, so that the heat generated as a result of the combustion of the remaining combustible compounds in the thermal reactor becomes remarkably high. It is observed that the temperature in the thermal reactor used in the above-stated condition exceeds 1000° C. very often.

If the thermal reactor is made of some heat resistant material to protect the same from the heat damage, the manufacturing cost is inevitably increased.

SUMMARY OF THE INVENTION

Accordingly, the present invention is proposed to eliminate the above-mentioned several drawbacks encountered in the prior art engine system equipped with the thermal reactor.

It is an object of the present invention to provide a control system for use with an internal combustion engine having at its exhaust system a thermal reactor to protect the thermal reactor from being overheated.

It is another object of the present invention to provide an air-fuel ratio control system which functions to allow the engine not only to be fed with a relatively rich air-fuel mixture when the engine is subjected to a relatively light load low speed operation but also to be alternately fed with a relatively lean air-fuel mixture and a relatively rich air-fuel mixture when the engine is subjected to a relatively heavy load high speed operation, so that the thermal reactor of the engine effectively operates without sacrificing the performance of the engine.

BRIEF DESCRIPTION OF THE DRAWINGS

Other objects and advantages of the present invention will become more clear from the following description when taken in conjunction with the accompanied drawings, in which.

DESCRIPTION OF THE PREFERRED EMBODIMENTS

Figure 1:
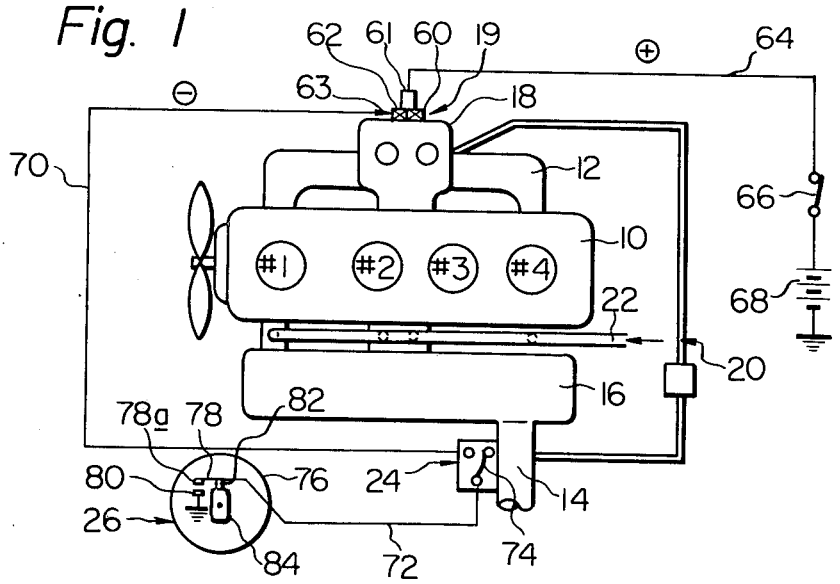
FIG. 1 is a sketch schematically showing a first preferred embodiment of a control system of the present invention.

Referring to FIG. 1 of the accompanied drawings, there is shown an internal combustion engine 10 with four combustion chambers #1, #2, #3 and #4. An intake conduit system 12, an exhaust conduit system 14 and a thermal reactor 16 are shown to connect to the engine 10 in a conventional manner. A carburetor a is mounted on an upstream portion of the intake conduit system 12 and has carburetor actuating means as will be described hereinafter. An the exhaust gas recirculating system 20 is arranged to this engine system to feed part of exhaust gases into the intake conduit system 12 for the purpose of reducing the nitrogen oxides ($NO_x$) in the exhaust gases. Furthermore, for assuring the effective combustion of the combustible compounds, such as carbon monoxide (CO) and hydrocarbons (HC) remaining in the exhaust gases from the engine 10, in the thermal reactor 16, a secondary air supply system 22 is provided on this engine system as shown.

Figure 2:
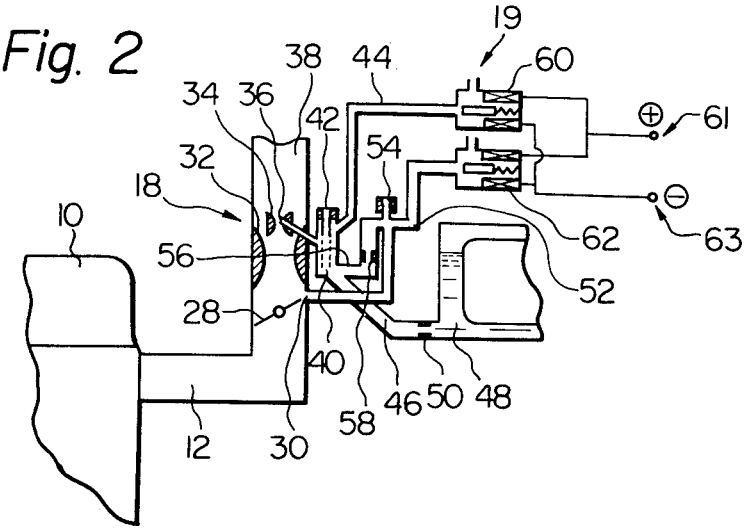
FIG. 2 is a sketch schematically illustrating a carburetor and carburetor actuating means employed in the control system of the present invention.

A control system according to the present invention generally comprises carburetor actuating means 19 connected to the carburetor 18, an exhaust gas temperature sensor 24 positioned adjacent the exhaust conduit system 14, and a contact breaker 26 actuated by the engine. The detailed constructions of the carburetor 18 and the means 19 are well shown in FIG. 2, in which a throttle valve 28 adjacent a slow port 30, a primary venturi 32 and a secondary venturi 34 with a main nozzle 36 are mounted in a barrel 38 of the carburetor 18 in a conventional manner. As shown in this drawing, the main nozzle 36 is fluidly connected at its lower end to an air mixing chamber 40 which has at its upper portion an air bleed 42, at its middle portion a primary conduit 44 and at its lower portion a conduit 46 communicating with a float chamber 48 through an orifice 50. The slow port 30 is connected to a secondary conduit 52 which is provided at its generally middle portion with an air bleed 54 and a tertiary conduit 56 fluidly connected through an orifice 58 to the above-mentioned conduit 46. The primary and secondary conduits 44 and 52 are connected at their leading ends to a primary electromagnetic valve 60 and a secondary electromagnetic valve 62, respectively. These valves 60 and 62 are electrically connected in parallel to form a common plus terminal 61 and a common minus terminal 63 and are arranged to open the respective conduits 44 and 52 when electrically energized and to close the conduits 44 and 52 when de-energized. With these constructions of the primary and secondary electromagnetic valves 60 and 62, it will be appreciated that the amount of fuel fed into the barrel 38 from each of the main nozzle 36 and the slow port 30 is decreased when the valves 60 and 62 are energized and, on the contrary, increased when the valves are de-energized. In this embodiment, the amounts of fuel fed into the barrel 38 from both of the main nozzle 36 and the slow port 30 are set to allow the air-fuel ratio of the air-fuel mixture fed into the combustion chambers #1, #2, #3 and #4 to be about 15/1 to 19/1 when the valves 60 and 62 are energized, and to be about 11/1 to 14/1 when the valves are de-energized.

Referring again to FIG. 1, the common plus terminal 61 is connected through a lead wire 64 to an ignition switch 66 and then to a battery 68, while the common minus terminal 63 is connected through a lead wire 70 to the exhaust gas temperature sensor 24 and then through a lead wire 72 to the contact breaker 26.

The exhaust gas temperature sensor 24 comprises a bimetal switch 74 which is disposed in the exhaust conduit system 14 and functions to accomplish an electrical connection between the common minus terminal 63 and the contact breaker 26 when the temperature of the exhaust gases in the exhaust conduit system 14 exceeds a predetermined level, for example, 900° C. If desired, the temperature switch 74 may be set in the thermal reactor 16 for more practically sensing the combustion temperature of the gases in the thermal reactor 16.

The contact breaker 26 generally comprises a base member 76 on which a swingable arm 78 with a contact point **78*a* and a stationary grounded contact point 80 are arranged. The swingable arm 78 is biased toward the stationary point 80 so as to make the contact point 78*a* contactable with the stationary point 80. A distance piece 82 is connected to a generally middle portion of the swingable arm 78 for a purpose which will be explained next. A generally rectangular cam member 84 is rotatably mounted on the base member at a position near the distance piece 80 in such a manner that the cam member 84 intermittently lifts up the swingable arm 78 through the distance piece 80 when rotated, for causing the contact point 78*a* on the swingable arm 78 to be intermittently disengaged from the stationary contact point 80. The cam member 84 is rotatably drived by the engine so as to be synchronous with the engine rotation, more specifically, the rotation speed of the cam member 84** is set to be half of that of the crankshaft of the engine.

With the above-mentioned construction of the control system of the present invention, the operation is as follows.

Under the normal running condition of the engine 10 wherein the exhaust gas temperature is below a predetermined level (900° C. in this instance), the bimetal switch 74 of the exhaust gas temperature sensor 24 fails to accomplish the electrical connection between the electromagnetic valves 60 and 62 and the contact breaker 26. Thus, in this condition, the valves 60 and 62 are de-energized to close the primary and secondary conduits 44 and 52 respectively thereby causing the air-fuel mixture in the barrel 38 rich to have the relatively low air-fuel ratio ranging from about 11/1 to 14/1.

Under this condition, the engine 10 produces the exhaust gases containing relatively large amounts of hydrocarbons (HC) and carbon monoxide (CO) so as to achieve the effective combustion of these compounds in the thermal reactor 16 with the assistance of the secondary air supply system 22 supplying the air into the thermal reactor 16.

On the contrary, when the engine is subjected to a high speed heavy load operation wherein the exhaust gas temperature exceeds the predetermined value (900° C. in this instance), the bimetal switch 74 of the exhaust gas temperature sensor 24 closes its circuit to accomplish the electrical connection between the electromagnetic valves 60 and 62 and the contact breaker 26. Thus, in this instance, the electromagnetic valves 60 and 62 are both subjected to ON-OFF repetitive operation in accordance with the intermittent switching action of the contact breaker 26. More specifically speaking, the valves 60 and 62 are energized instantly two times while the cam member 84 rotates fully once. In other words, the valves 60 and 62 are energized one time while the crankshaft of the engine 10 rotates fully once.

Under this condition, the primary and secondary conduits 44 and 52 are intermittently open or closed thereby causing the air-fuel mixture in the barrel 38 to alternatively have two types of air-fuel ratio which range from 15/1 to 19/1, and 11/1 to 14/1 respectively. This procedure will cause the temperature drop in the thermal reactor 16 by the reasons which will be explained hereinlater.

When the temperature of the exhaust gases from the thermal reactor 16 drops below the predetermined level (900° C.), the bimetal switch 74 of the exhaust gas temperature sensor 24 opens its circuit to make the electromagnetic valves 60 and 62 inoperative. The combustion chambers #1, #2, #3 and #4 are thus fed with the relatively rich air-fuel mixture with the air-fuel ratio ranging from about 11/1 to 14/1, again.

The followings are given for explaining the details of synchronizing procedure performed by the contact breaker 26.

Figure 3:
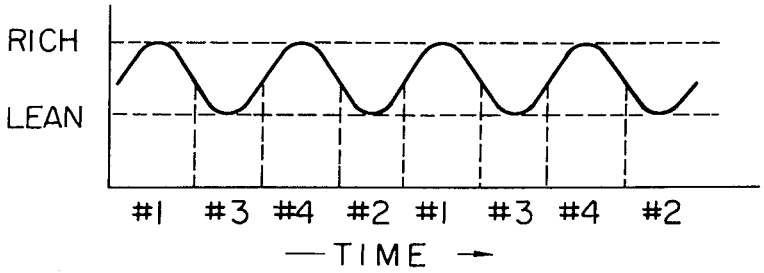
FIG. 3 is a chart representing the function of the carburetor actuating means illustrated in FIG. 2.

When the firing order of the combustion chambers of the engine 10 is #1-#3-#4-#2, the air-fuel mixture fed into respective combustion chambers will has such characteristics as shown in the chart of FIG. 3. This chart represents that the chambers #1 and #4 are fed with a relatively rich mixture and the remaining chambers #3 and #2 are fed with a relatively lean mixture. It will now be noted that, by changing the firing order of the combustion chambers, any kinds of rich-lean mixture feeding cycles are readily obtained.

Our several experiments have revealed that when the combustion chambers #1 and #4 are fed with the rich mixture with the air-fuel ratio of about 12.5/1 to 13/1, and the combustion chambers #3 and #2 are fed with the lean mixture with a ratio of about 16.5/1 to 17/1, the amounts of hydrocarbons (HC) and carbon monoxide (CO) in the exhaust gases emitted from the combustion chambers are reduced to half in comparison with a case wherein the all combustion chambers #1, #2, #3 and #4 are fed with the rich mixture.

Figure 4:
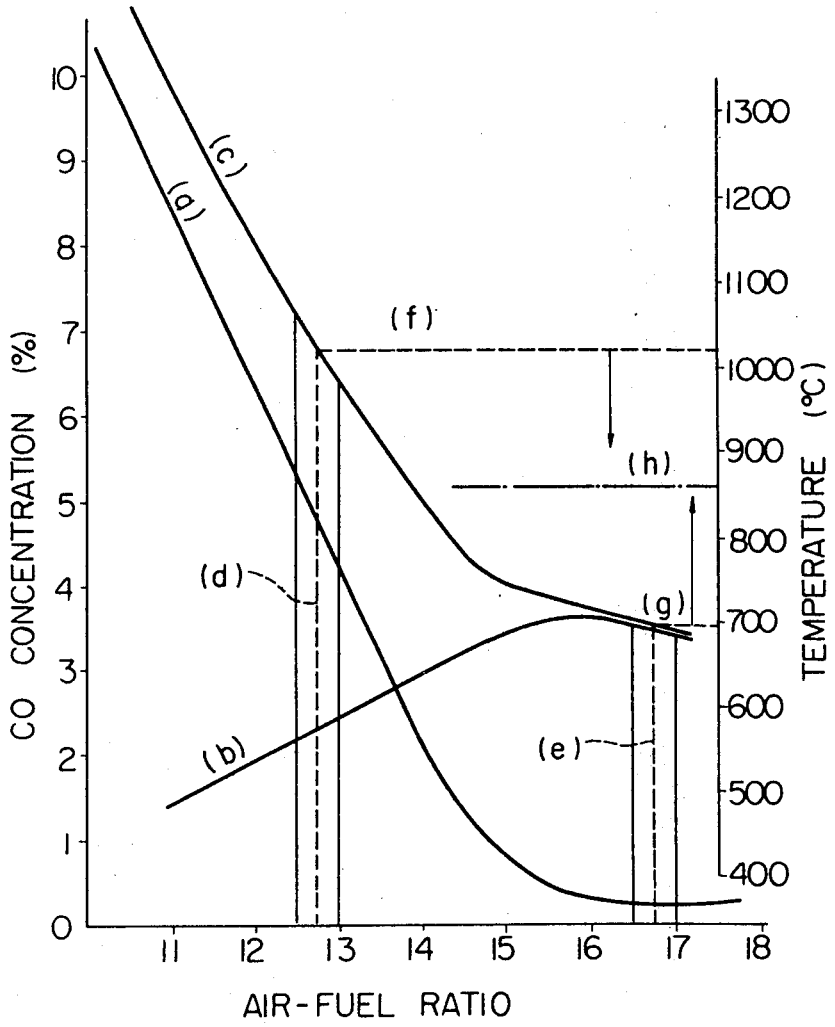
FIG. 4 is a graph showing the mutual relationship among the air-fuel ratio, the exhaust gas temperature, and the concentration of carbon monoxide (CO) in the exhaust gases.

In order to more clarify the advantages of this first preferred embodiment, a graph illustrated in FIG. 4 will be given. In this graph, the curve marked by *a* indicates the relationship between the air-fuel ratio of the air-fuel mixture fed into the engine 10 and the concentration of carbon monoxide (CO) in the exhaust gases emitted from the combustion chambers of the engine 10, and the curve *b* indicates the relation between the air-fuel ratio of the mixture and the temperature of the exhaust gases emitted from the combustion chambers of the engine 10 under a predetermined engine running condition. Further, the curve *c* represents the relationship between the temperature in the thermal reactor 16 and the air-fuel ratio of the air-fuel mixture. As is well known, the temperature in the thermal reactor 16 is critically dependent on the combustion condition of the combustible compounds in the exhaust gases fed from the engine 10 into the thermal reactor 16.

From the curve *c*, it will be recognized the following points. If all of the combustion chambers #1, #2, #3 and #4 are fed with the relatively rich air-fuel mixture having the air-fuel ratio ranging from about 12.5/1 to 13/1 (average ratio = 12.75:(*d*)), the temperature in the thermal reactor 16 becomes about 1025° C. as indicated by a line *f*, on the contrary, if the combustion chambers #1, #2, #3 and #4 are fed with the relatively lean air-fuel mixture having the air-fuel ratio ranging from about 16.5/1 to 17.0/1 (average ratio = 16.75/1:(*e*)), the temperature in the thermal reactor 16 becomes about 695° C. as indicated by a line *g*. Thus, it will be apparent that the temperature in the thermal reactor 16 attains about 860° C. (medium value (*h*) between 1025° C. and 695° C.) when the combustion chambers #1 and #4 and the remaining combustion chambers #3 and #2 are fed with the relatively rich mixture and lean mixture, respectively. At this temperature, the thermal reactor 16 will not be damaged and still functions to sufficiently burn out the combustible compounds in the exhaust gases from the engine 10.

Figure 5:
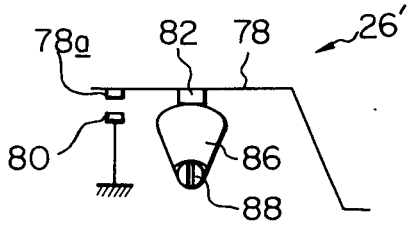
FIG. 5 is a sketch showing one type of contact breaking member usable in the control system in the invention.

Referring to FIG. 5, there is illustrated another type of contact breaker 26' which comprises generally same parts as in the case of FIG. 1 except for a cam member 86. The cam member 86 of this type is formed into a generally triangular shape having one vertex portion fixed to a rotatable axis 88. The rotatable axis 88 is powered by the engine so that the rotation of the axis 88 is simultaneous with the engine rotation, more specifically, the rotation speed of the axis 88 and thus of the triangular cam member 86 is set to be half of that of the crankshaft of the engine.

Figure 6:
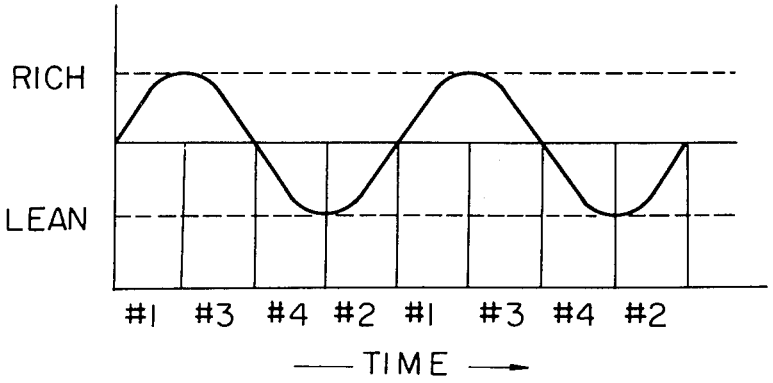
FIG. 6 is a chart schematically representing the function of carburetor actuating means with respect to the contact breaking member shown in FIG. 5.

With this arrangement of the cam member 86, the air-fuel mixture fed into the combustion chamber will have such characteristics as indicated in the chart of FIG. 6. This chart represents that the combustion chambers #1 and #3 are fed with relatively rich mixture and the remaining combustion chambers #4 and #3 are fed with the relatively lean mixture.

Figure 7:
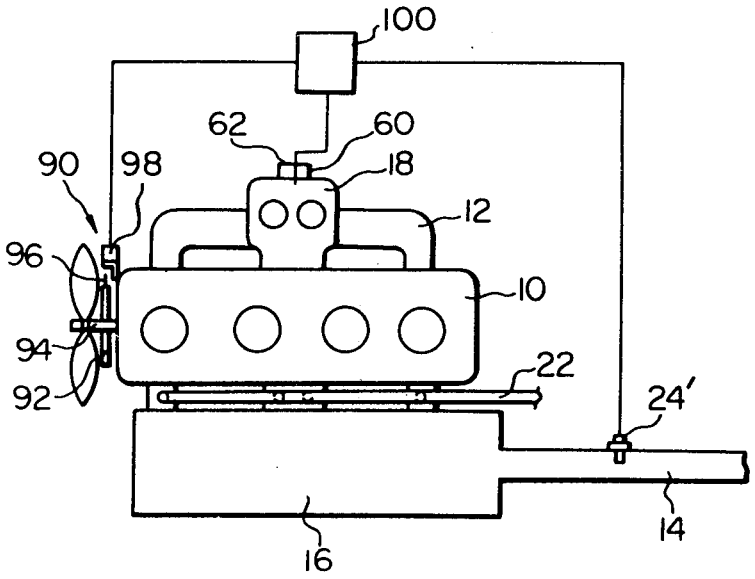
FIG. 7 is a sketch schematically showing the second preferred embodiment of a control system of the present invention.

FIG. 7 shows the second preferred embodiment of the present invention. In this case, the control system generally comprises the electromagnetic valves 60 and 62 connected to the carburetor 18 in a same manner as previously described, an exhaust gas temperature sensor 24' which is disposed in the exhaust conduit system positioned downstream of the thermal reactor 16 for detecting the temperature of the exhaust gases passing through the conduit system 14. An engine speed sensor 90 is mounted in the vicinity of the engine 10. The engine speed sensor 90 comprises a support member 92 fixed to a crankshaft 94 of the engine 10 so as to be rotatable therewith. On an edge portion of the support member 92 is connected a permanent magnet 96. Stationarily supported by the engine 10 is a pick-up coil 98 which is located near the circular path swept out by the permanent magnet 96 and functions to generate a signal when the magnet 96 passes through the neighborhood thereof. Thus, one signal is generated per one rotation of the crankshaft. A control unit 100 is arranged to receive such information signals from the exhaust gas temperature sensor 24' and the engine speed sensor 90 for sending to the electromagnetic valves 60 and 62 command signals so that the valves 60 and 62 are subjected to ON-OFF repetitive operation in proportion to the engine speed when the temperature of the exhaust gases from the thermal reactor 16 exceeds a predetermined level corresponding to a temperature of, for example, 900° C. in the thermal reactor 16. With this construction, the advantageous functions mentioned in the first embodiment are expected also in this second embodiment.

In addition to the above-mentioned first and second preferred embodiments of the control system according to the present invention, the following modifications and changes may be employed, which are:

(1) Although in the previous description, the electromagnetic valves 60 and 62 are so arranged to indirectly control the flow rate of fuel fed into the barrel 38 of the carburetor 18, it is also possible to arrange such valves in the corresponding fuel conduits so as to directly control the flow rate of the fuel.

(2) The detection of engine speed may be made by sensing the trigger voltage of the distributor equipped to the engine.

(3) The cntrol system of the present invention may be so arranged to operate only when the vehicle equipped with it undergoes low and/or medium running speed. In this case, the fuel economy of the engine is considerably improved.

(4) These kinds of control system of the present invention may be readily applied not only to the prior mentioned four-cylinder type internal combustion engine but also to any other multi-cylinder type engines such as six-cylinder type engines and eight-cylinder type engines.

In summary, with the above-described control system of the present invention, it is possible, under normal running condition of the engine, to supply the engine with a relatively rich air-fuel mixture for regulating the concentration of combustible compounds such as hydrocarbons (HC) and carbon monoxide (CO) in the exhaust gases, emitted from the engine, in a manner that the thermal reactor effectively functions, and under high speed heavy load condition of the engine in which the exhaust gas temperature exceeds the predetermined level, to supply the engine with the relatively rich mixture and the relatively lean mixture alternately in accordance with the engine speed for not only achieving the improved fuel economy but also protecting the thermal reactor from being attacked by the exhaust gases having remarkably high heat.

Although, in the previous description, only few embodiments have been shown and described, the invention is not limited to the disclosed embodiments but is defined by the following claims.

What is claimed is:

1. For use with an internal combustion engine, a system for controlling the air-fuel ratio of an air-fuel mixture fed through a carburetor, into said internal combustion engine having a thermal reactor in its exhaust system, comprising:

carburetor-actuating means connected to a carburetor of an internal combustion engine and having first and second states thereof, said first state being a state wherein said carburetor is actuated to feed the engine with a relatively lean air-fuel mixture and said second state being a state wherein said carburetor is actuated to feed the engine with a relatively rich air-fuel mixture, said carburetor-actuating means including at least one electromagnetic valve fluidly connected to said carburetor, the electric energization and de-energization of said electromagnetic valve respectively inducing said first and second states;

a temperature sensor for sensing the temperature of said thermal reactor on said engine; and control means for allowing said electromagnetic valve to be continuously de-energized while said temperature sensor senses a temperature below a predetermined level and to be alternately energized and de-energized while said temperature sensor senses a temperature above said predetermined level, said control means including synchronizing means allowing predetermined cylinders of said engine to be fed with only said relatively rich air-fuel mixture and alternately cylinders other than said predetermined cylinders to be fed with only said relatively lean air-fuel mixture during a condition wherein said temperature sensor senses the temperature above said predetermined level.

2. A system as claimed in claim 1, in which said synchronizing means comprises a stationary contact connected to an electrical power source, a swingable arm with a movable contact contactable with said stationary contact, said movable contact being connected to said electromagnetic valve through said temperature sensor, and a driven rotatable cam member operable to intermittently lift up said swingable arm to intermittently disengage said movable contact from said stationary contact when continuously rotated, said cam member being driven in timed relationship with a crankshaft of said engine during rotation thereof.

3. A system as claimed in claim 1, in which said synchronizing means comprises a driven permanent magnet driven in timed relationship with a crankshaft of said engine, a pick-up coil stationarily positioned to generate a signal when said magnet passes through the neighborhood thereof, and a control unit for allowing said electromagnetic valve to be energized upon receiving said signal from said pick-up coil when said temperature sensor senses a temperature above said predetermined level.

4. A system as claimed in claim 1, further comprising a secondary air supply system supplying additional air into said thermal reactor.

5. A system for controlling the air-fuel ratio of an air-fuel mixture fed through a carburetor having a throttle valve into an internal combustion engine provided with a thermal reactor in its exhaust system, comprising:

carburetor-actuating means connected to said carburetor of said internal combustion engine having said thermal reactor, said carburetor having first and second states thereof, said first state being a state wherein said carburetor is actuated to feed the engine with a relatively lean air-fuel mixture and said second state being a state wherein said carburetor is actuated to feed the engine with a relatively rich air-fuel mixture, said carburetor-actuating means including a primary electromagnetic valve fluidly connected to a main fuel nozzle open into a barrel of said carburetor at a position upstream of said throttle valve, the amount of fuel fed from said main fuel nozzle into said barrel being respectively decreased and increased when said primary electromagnetic valve is energized and de-energized, and a secondary electromagnetic valve fluidly connected to a slow port open to said barrel of said carburetor at a position adjacent said throttle valve, the amount of fuel admitted from said slow port into said barrel being respectively decreased and increased when said secondary electromagnetic valve is energized and de-energized, connections connecting said primary and secondary electromagnetic valves in parallel so that energization of said primary and secondary electromagnetic valves induces said first state of said carburetor actuating means and de-energization of the same induces said second state of said carburetor actuating means;

a temperature sensor for sensing the temperature of said thermal reactor; and control means for allowing said primary and secondary electromagnetic valves to be continuously de-energized while said temperature sensor senses a temperature below a predetermined level and to be alternately energized and de-energized while said temperature sensor senses a temperature above said predetermined level, said control means including synchronizing means for allowing predetermined cylinders of said engine to be fed with only said relatively rich air-fuel mixture and alternately cylinders other than said predetermined cylinders to be fed with only said relatively lean air-fuel mixture during the condition wherein said temperature sensor senses the temperature above said predetermined level.

6. A system as claimed in claim 5, in which said synchronizing means comprises a stationary contact connected to an electrical power source, a swingable arm with a movable contact contactable with said stationary contact, said movable contact being connected to said primary and secondary electromagnetic valves through said temperature sensor, and a driven rotatable cam member operable to intermittently lift up said swingable arm to intermittently disengage said movable contact from said stationary contact when continuously rotated, said cam member being mechanically driven in timed relationship with a crankshaft of said engine during rotation thereof.

7. A system as claimed in claim 6, in which the rotation speed of said cam member is set to be half of that of said crankshaft.

8. A system as claimed in claim 7, in which said cam member is so formed to lift up said swingable arm, to disengage said movable contact from said stationary contact two times while said cam member rotates once.

9. A system as claimed in claim 8, in which said cam member is so formed to lift up said swingable arm, for disengaging said movable contact from said stationary contact, one time while said cam member rotates once.

10. A system as claimed in claim 5, in which said synchronizing means comprises a permanent magnet connected to a crankshaft of said engine so as to rotate therewith, a pick-up coil stationarily positioned adjacent said crankshaft to generate a signal when said magnet passes through the neighborhood thereof, and a control unit for allowing said primary and secondary electromagnetic valves to be energized upon receiving said signal from said pick-up coil when said temperature sensor senses a temperature above said predetermined level.

11. A system as claimed in claim 5, further comprising a secondary air supply system for supplying additional air into said thermal reactor.

12. A system as claimed in claim 11, further comprising an exhaust gas recirculating system for feeding a fraction of exhaust gases emitted from said thermal reactor into said carburetor.

* * * * *